US005971141A

United States Patent [19]

Shafik

[11] Patent Number: 5,971,141

[45] Date of Patent: Oct. 26, 1999

[54] TOILET ACCESSORY KIT

[76] Inventor: Aasef M. Shafik, 5408 Carlin Spring Rd., Arlington, Va. 22203

[21] Appl. No.: 09/052,175

[22] Filed: Mar. 31, 1998

[51] Int. Cl.[6] ..... B65D 69/00

[52] U.S. Cl. ..... 206/225; 206/361; 206/823; 4/255.11

[58] Field of Search ..... 4/255.01, 255.11; 206/15.3, 216, 225, 361, 576, 823; 312/206

[56] References Cited

U.S. PATENT DOCUMENTS

| | | | |
|---|---|---|---|
| D. 161,014 | 11/1950 | Gerson | D6/551 |
| D. 272,874 | 3/1984 | Cohen | D6/551 |
| D. 356,893 | 4/1995 | Conmy | D4/116 |
| 1,758,962 | 5/1930 | Miller | 601/6 |
| 2,066,773 | 1/1937 | Felice | 4/255.05 |
| 2,423,292 | 7/1947 | Brown | 211/65 |
| 2,441,697 | 5/1948 | Gage | 248/110 |
| 2,464,085 | 3/1949 | Hess | 206/361 |
| 2,539,838 | 1/1951 | Hurley | 312/206 |
| 2,844,826 | 7/1958 | Cheiten | 4/255.11 |
| 3,021,532 | 2/1962 | Gross | 4/255.11 |
| 3,429,474 | 2/1969 | Cann | 220/555 |
| 4,008,933 | 2/1977 | Wanek | 312/206 |
| 4,033,650 | 7/1977 | Alissandratos | 312/206 |
| 4,432,451 | 2/1984 | Hooser | 206/216 |
| 4,458,368 | 7/1984 | Webb | 4/255.11 |
| 4,831,669 | 5/1989 | Edwards | 4/255.11 |
| 4,887,713 | 12/1989 | Tupper | 206/225 |
| 5,035,321 | 7/1991 | Denton | 206/225 |
| 5,099,527 | 3/1992 | Roose | 4/255.11 |
| 5,353,442 | 10/1994 | Rotter | 4/255.11 |
| 5,456,356 | 10/1995 | Kurzawa | 206/349 |

*Primary Examiner*—Robert M. Fetsuga
*Attorney, Agent, or Firm*—Dennia H. Lambert

[57] ABSTRACT

A toilet accessory kit includes a holder with receptacles at opposite ends receiving and holding a toilet brush and a toilet plunger, respectively. A divider extends across the holder to separate the receptacles from one another, and a handle extends from the divider for lifting and carrying the holder and also for storing extra rolls of toilet paper. The brush includes bristles and an elongate narrow pick, with the pick insertable into the jets beneath the rim of a toilet bowl to clean the jets. The plunger has a spherical member with a concavo-convex open end that fits various sizes of drain openings. A depending cylindrical skirt surrounds the concavo-convex open end and acts as a shield to prevent splashing and also forms a secondary seal.

20 Claims, 4 Drawing Sheets

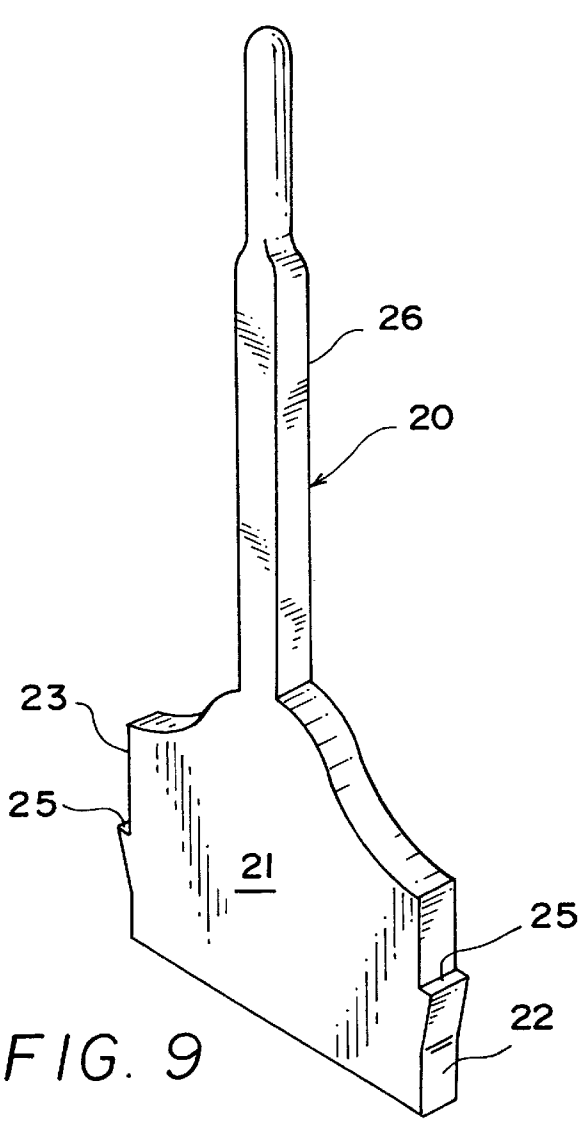
FIG. 9
FIG. 7
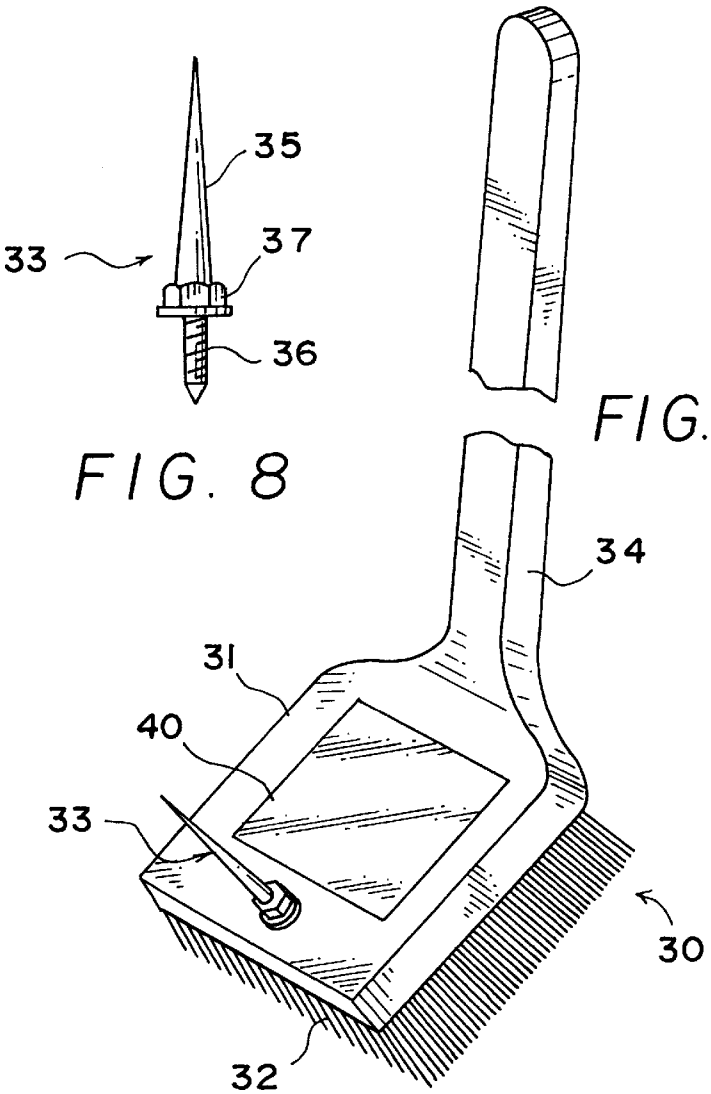
FIG. 8

TOILET ACCESSORY KIT

BACKGROUND OF THE INVENTION

1. Field of the Invention

This invention relates to bathroom accessories, and more particularly, to a toilet accessory kit containing a plunger, a combined brush and water jet cleaning implement, and storage means for one or more rolls of toilet paper.

2. Prior Art

Residential and commercial toilets require frequent cleaning, and may also sometimes require clearance of a blockage which prevents proper drainage of water from the toilet. The most frequently used cleaning implement is a brush or similar tool which is used to scrub the toilet bowl. If the drain from the toilet becomes blocked, a plunger is commonly used to alternately produce pressure and suction in the trap to dislodge the obstruction. Both brushes and plungers are available in a variety of shapes and sizes.

Although conventional brushes perform adequately for cleaning the surfaces of the toilet bowl, they are not adapted for cleaning the jets which introduce water into the toilet beneath the rim of the bowl. In fact, these jets are rarely if ever cleaned by the average homeowner and may eventually become partially or completely blocked, thereby impeding the proper performance of the toilet.

A variety of prior art plungers are exemplified in U.S. Pat. Nos. 2,066,773, 2,844,826, 3,021,532, and 4,458,368. U.S. Pat. No. 2,066,773 discloses a drain and flushing apparatus comprising a cup-shaped member surrounded by a skirt 11. Water may be introduced into the interior of the cup-shaped member to generate pressure and flush out a clogged drain, while the outer skirt 11 serves to seal and hold the device to a sink basin or the like, by acting as a suction cup.

U.S. Pat. No. 2,844,826 discloses a plunger having a specially configured bell 12 surrounding an inner guide portion 28. The inner guide portion comprises an extension from the open end of the bell 12 and serves to fit the device into openings of various size. In use, the guide and locking member 28 serves as the leading edge of the plunger, and is directed into the trap opening where it adjusts to the size and shape of the trap opening. Reciprocating force applied to the handle 20 alternately compresses and expands the corrugated wall of the bell 12 and applies pressure or suction forces upon the fluid in the trap opening to clear any obstruction.

U.S. Pat. No. 3,021,532 discloses a plunger having a cup-shaped body portion 10 terminating in an annular flange 16. A flexible skirt 32 is attached to and extends from the bottom edge of the cup. The skirt 32 is adapted to fit various trap openings, and may have an extended position as shown in FIG. 3, or a retracted position as shown in FIG. 4. In operation, to remove an obstruction from a trap in a flat sink or the like, the flexible skirt 32 is moved into its retracted position, and the plunger is used conventionally. When the surface is not flat, such as the entrance to a trap in a toilet, the flexible skirt 32 is extended to its outer position and inserted into the trap as far as it will go. The skirt thus adapts to different size trap openings and effects a seal so that upon operation of the handle in the conventional manner, pressure can be generated to dislodge the obstruction.

U.S. Pat. No. 4,458,368 discloses a conventional plunger member 14, with a large circular or oval shaped shield 20 disposed on the plunger handle to protect the user against splashing caused by operation of the plunger.

U.S. Pat. Nos. 4,831,669 and 5,099,527 also disclose conventional plunger constructions, and shields which may be applied to the handle to guard against splashing caused by use of the plunger.

U.S. Pat. Nos. 5,353,442 and 5,456,356 disclose other plunger related tools and accessories. U.S. Pat. No. 5,353,442 describes a rapid action plunger in which a handle and lever system is connected with a plunger-like device for extending and retracting the plunger-like device to remove an obstruction. U.S. Pat. No. 5,456,356 describes a plunger accessory including a housing which encloses the plunger and has an elongate handle portion upon which extra rolls of toilet paper may be stored.

Design Pat. Des. 161014 and Des. 272874, and U.S. Pat. Nos. 2,464,085, 2,539,838, 3,429,474 and 4,033,650 all disclose toilet brush holders of various styles and constructions.

Design Pat. Des. 356893 and utility patent No. 4432451 both disclose devices for holding and storing toilet plungers. In addition, Des. 356893 discloses use of the device for holding a brush.

None of the patents noted above discloses a tool for cleaning the jets in a toilet bowl, nor do any of them disclose a toilet accessory kit comprising a holder with means for supporting a toilet brush, plunger, and extra rolls of toilet paper, wherein a cover may be provided to enclose the brush, plunger, and toilet paper, thereby making the accessory kit aesthetically pleasing for storage in a bathroom. In prior art devices, the toilet brush and plunger are either stored in the open and in plain sight in a bathroom, detracting from the decor of the bathroom, or the brush and plunger are stored in a remote location, detracting from the convenience of use.

Accordingly, there is need for a toilet accessory kit which is aesthetically pleasing so that it may be left in a bathroom without detracting from the decor thereof, and which includes all of the tools normally used in cleaning a toilet, including means for cleaning the jets in the toilet bowl, and a plunger with a compact integrated splash shield.

SUMMARY OF THE INVENTION

In accordance with the present invention, a toilet accessory kit is provided which includes a toilet cleaning brush and jet cleaning tool, and a plunger, with a cover to make the kit aesthetically pleasing so that it may be conveniently stored in the bathroom.

The holder comprises a one-piece molded base section with a receptacle in each end of the base member, on opposite sides of the divider, for holding a brush and a plunger, respectively. The receptacles include an upstanding handle attached thereto, and a cup in one end for receiving and holding the brush and jet cleaning tool, and a cup-shaped recess in the other end for receiving and holding the plunger. The handle is attached to the base member and is configured to receive and store one or more rolls of toilet paper.

The toilet cleaning brush and jet cleaning tool are incorporated into a single implement, and the implement is constructed to facilitate use of both the brush and the jet cleaning tool.

The plunger in the kit of the invention includes a central, generally spherically-shaped member with an open lower end that is shaped to fit various size openings, and a depending skirt surrounding the open lower end of the spherically-shaped member to effect a secondary seal against a surface surrounding the drain on which the plunger is being used, and to provide a shield to protect the user against splashing caused by operation of the plunger.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 7 is an enlarged fragmentary perspective view of the brush and jet cleaning tool of the invention;

FIG. 8 is an enlarged view in side elevation of the jet cleaning instrument used with the tool in FIG. 7; and FIG. 9 is a perspective view of the handle and divider member used in the holder of the invention.

DETAILED DESCRIPTION OF THE PREFERRED EMBODIMENTS

Figure 1:
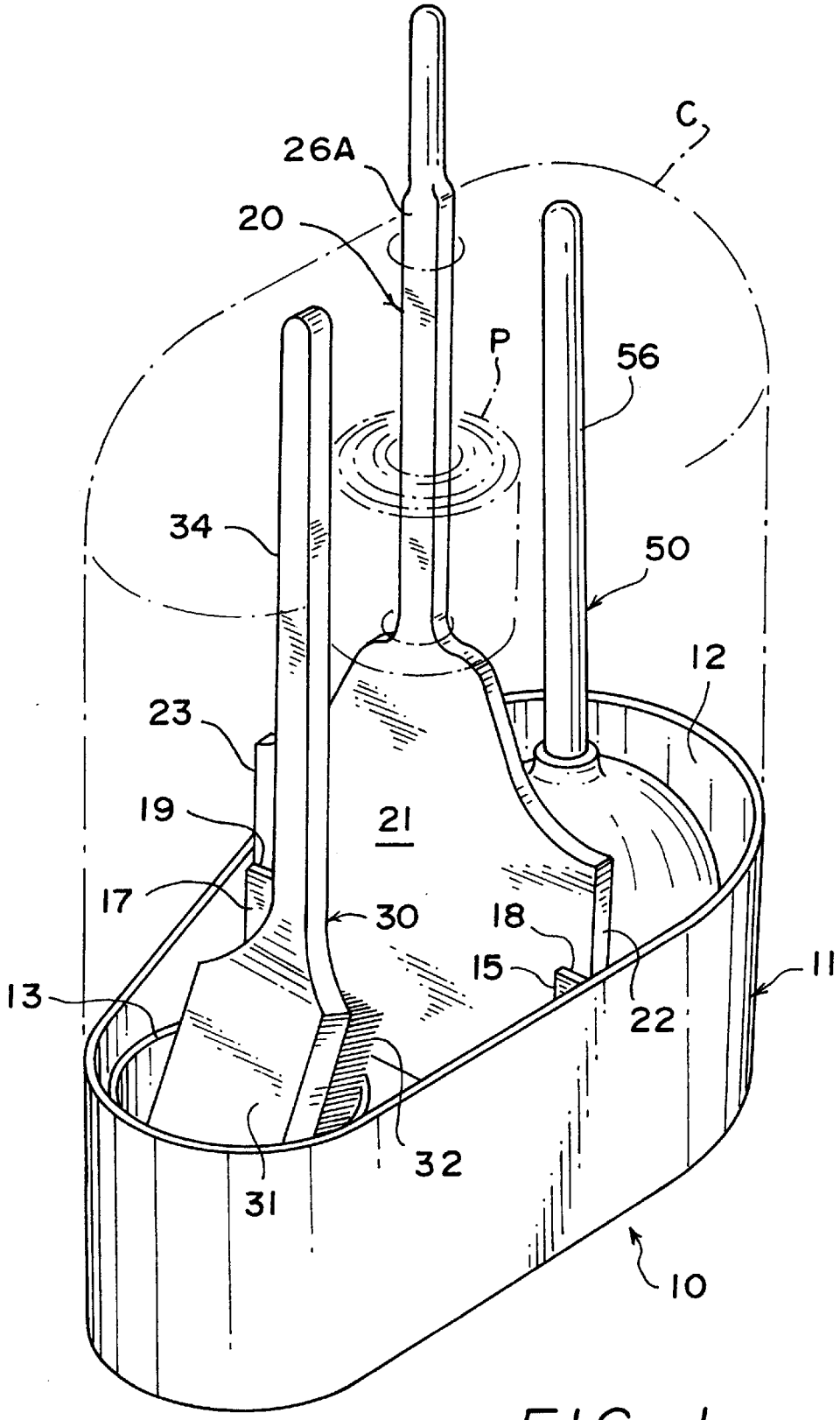
FIG. 1 is a top perspective view of the toilet accessory kit of the invention, showing the cover in dot-and-dash lines.
Figure 2:
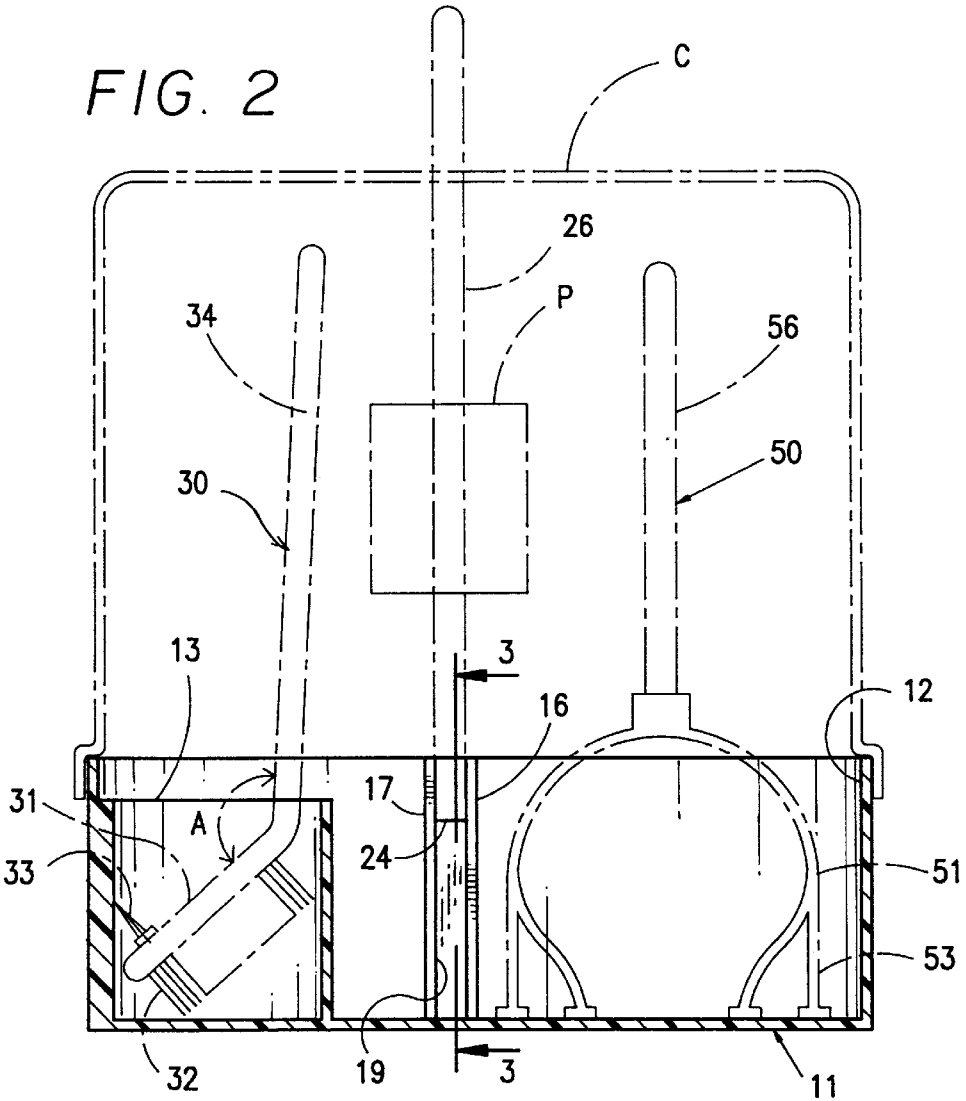
FIG. 2 is a longitudinal sectional view of the kit of FIG. 1, showing the handle, brush, plunger, cover, and a roll of toilet paper in dot-and-dash lines.
Figure 6:
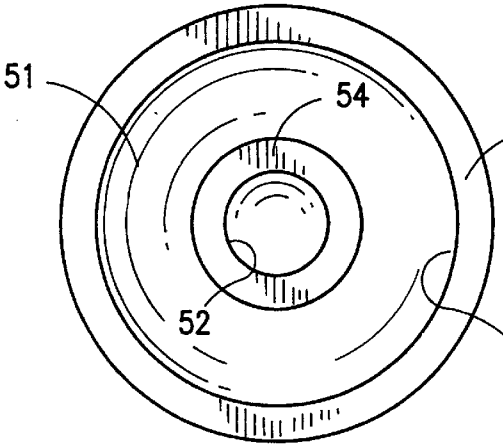
FIG. 6 is an end view of the plunger of FIG. 5, looking into the open end of the plunger.
Figure 5:
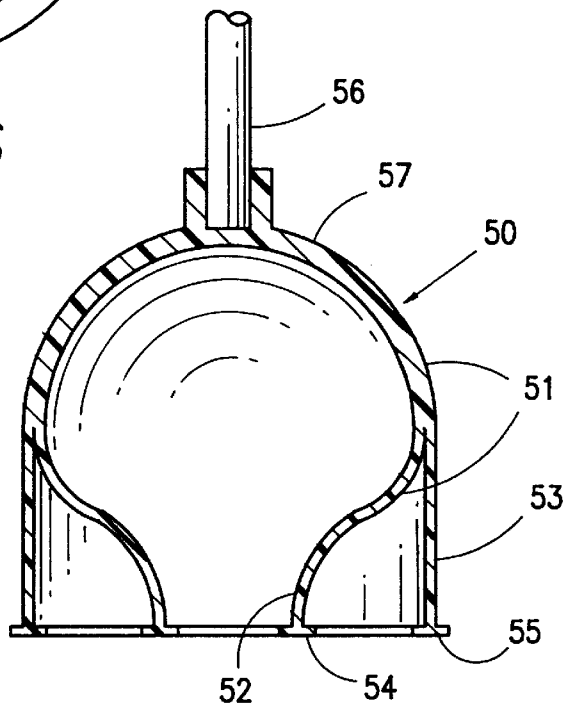
FIG. 5 is an enlarged fragmentary vertical sectional view of the plunger of the kit of the invention.
Figure 4:
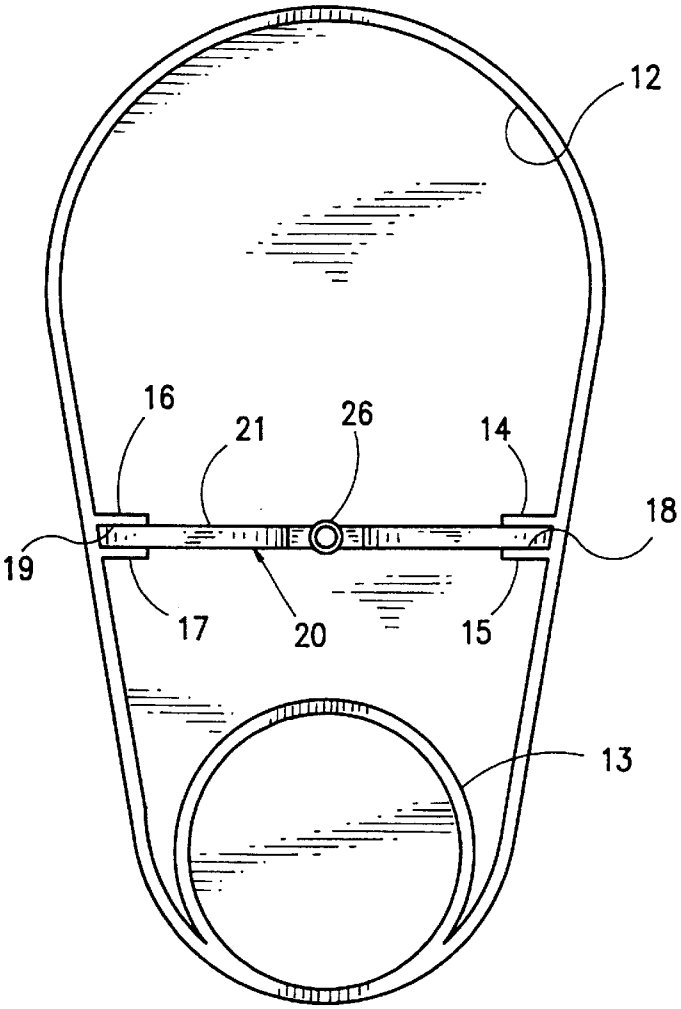
FIG. 4 is a top plan view of the holder of the kit of the invention, with the brush and plunger removed.

Referring more specifically to the drawings, a toilet accessory kit according to the invention is indicated generally at 10 in FIGS. 1 and 2. The kit includes a base member 11 having generally an elongate egg-shape in plan view and defining an enlarged substantially circular cavity 12 in one end. A cup-shaped receptacle 13 is integrally molded in the opposite end, and two pairs of parallel, spaced-apart flanges 14, 15 and 16, 17 are formed on the inner surfaces of the side walls of the base member, approximately midway between the opposite ends thereof, and oriented directly opposite one another to form opposing, vertically extending channels 18 and 19.

A combination divider and handle member 20 has a wide lower end portion 21 with opposite side edges 22 and 23 received in the channels 18 and 19 to form a dividing wall extending across the base member 11, separating it into the opposite end portions.

Figure 3:
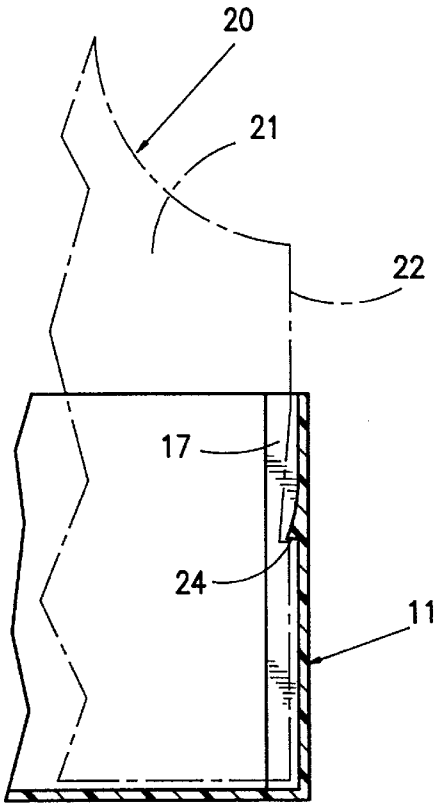
FIG. 3 is an enlarged fragmentary sectional view taken along line 3—3 in FIG. 2.

As seen best in FIGS. 2 and 3, a tapered shoulder with a downwardly facing ledge 24 is formed in each channel 18 and 19 for cooperation with an oppositely tapered shoulder having an upwardly facing ledge 25 on each of the opposite side edges of the lower portion 21 to lock the handle member and divider in place when it is inserted into the channels 18 and 19. Thus, the base member may be easily manufactured as a one-piece unit, with the handle member being separately manufactured as a unit and then assembled to the base member.

The handle and divider member includes an elongate upstanding handle 26 for carrying the holder. Additionally, the handle is shaped and sized to receive thereover one or more rolls of toilet paper P for storing extra rolls.

A combined brush and jet cleaning tool 30 is supported in the cup-shaped receptacle 13 in one end of the base member 11 and comprises a head 31 having bristles 32 projecting from one side thereof and a tapered jet-cleaning pick 33 projecting from the other side. An elongate handle 34 extends at an angle "A" from the head 31. The angle "A" is selected so that the tool is particularly suited for using either the bristles 32 or the pick 33. In a preferred construction, for example, the angle "A" may range from about 25° up to about 45°.

As seen in FIG. 8, the pick 33 includes an elongate tapered end 35 that may be inserted into the jets to clean them, and a threaded end 36 for threaded engagement in a mating opening (not shown) in an edge portion of the brush head 31. Suitably shaped surfaces 37 may be provided for manipulating the pick 33 with a suitable tool.

If desired, a reflective surface 40, such as a mirror, may be provided on the back of the brush head 31 to facilitate ease of use by reflecting an image of the jets so that the user can accurately position the pick when the tool is used.

A plunger 50 is supported in the end 12 of the base member 11 and comprises a generally spherically-shaped member 51 having a concavo-convex open end 52 of reduced diameter, and a depending cylindrical skirt 53 extending downwardly around the open end 52 from approximately the midpoint of the spherical member 51. Annular flanges 54 and 55 are formed on the bottom ends of the concavo-convex section 52 and the skirt 53, respectively, and an elongate handle 56 is attached to the upper, closed end 57 of the spherical member. The spherical member and skirt are integrally formed as one piece from any suitable material, such as rubber, commonly employed in the manufacture of plungers.

In use, the concavo-convex open end 52 of spherical member 51 is adapted to fit into and seal with various size openings, and the cylindrical skirt 53 is adapted to seal against the surface surrounding the opening to serve as a splash shield and also to form a secondary seal between the plunger and the opening of the drain which is clogged.

In a preferred embodiment, a cover C is placed over the base member 11 in enclosing relationship to the handle member 20, brush 30 and plunger 50, with only an end portion of the handle 26A exposed through the top of the cover to permit lifting and carrying of the kit.

While particular embodiments of the invention have been illustrated and described in detail herein, it should be understood that various changes and modifications may be made to the invention without departing from the spirit and intent of the invention as defined by the scope of the appended claims.

What is claimed is:

1. A toilet accessory kit, comprising:

an asymmetric holder having opposite ends defining receptacles, one of said ends being larger than the other, and each end having a rounded configuration;

a divider extending across the holder and separating the receptacles from one another;

an upright holder handle attached to the divider for carrying the holder;

a toilet brush received and supported in one of said receptacles, said brush having a handle projecting upwardly therefrom;

a toilet plunger received and supported in the other of said receptacles; and said holder handle extending above the holder a distance greater than the upwardly projecting toilet brush and toilet plunger handles.

2. A toilet accessory kit as claimed in claim 1, wherein:

said handle is shaped and sized to receive and hold at least one roll of toilet paper.

3. A toilet accessory kit as claimed in claim 2, wherein:

a removable cover is on said holder, enclosing the toilet brush and plunger.

4. A toilet accessory kit as claimed in claim 3, wherein:

said holder comprises a base member having a bottom wall and an upstanding side wall; and said divider is secured to said side wall.

5. A toilet accessory kit as claimed in claim 4, wherein:

the receptacle for said brush comprises a cup-shaped member in said one end of said holder.

6. A toilet accessory kit as claimed in claim 5, wherein:

said one end of said holder is smaller in a transverse direction than said other end.

7. A toilet accessory kit as claimed in claim 6, wherein:

said ends of said holder are rounded and are joined to one another by straight sides.

8. A toilet accessory kit as claimed in claim 7, wherein:

said base member, including said cup-shaped member, comprises a unitary plastic structure.

9. A toilet accessory kit as claimed in claim 8, wherein:

said divider and said handle are formed as one piece, separate from the base member, and then secured to the base member to form the holder.

10. A toilet accessory as claimed in claim 1, wherein:

said divider and said handle are formed as one piece, separate from the base member, and then secured to the base member to form the holder.

11. A toilet accessory as claimed in claim 10, wherein:

the receptacle for said brush comprises a cup-shaped member in said one end of said holder.

12. A toilet accessory as claimed in claim 11, wherein:

said base member, including said cup-shaped member, comprises a unitary plastic structure.

13. A toilet accessory as claimed in claim 1, wherein:

said plunger comprises a spherically shaped member having a concavo-convex open end, and a depending cylindrical skirt around the open end, said skirt attached at one end to a midportion of the spherical member and coterminous at its other end with the open end of the spherically shaped member, said skirt serving as a splash shield and forming a secondary seal when in use, and said concavo-convex open end of the spherical member adapted to fit into and seal with a range of different size openings.

14. A toilet accessory as claimed in claim 1, wherein:

said brush comprises a brush head having bristles projecting from one side and an elongate narrow pick extending from the other side, said pick adapted to extend into and clean water inlet jets beneath a rim in a toilet bowl; and a handle extending at an angle from the head to facilitate use of both the bristles and the pick.

15. A toilet accessory as claimed in claim 14, wherein:

the handle extends at an angle of from about 20° to about 45° relative to the head.

16. A toilet accessory as claimed in claim 15, wherein:

a reflective surface is on the side of said head from which the pick projects, to enable a user to see the jets into which the pick is to be inserted during use.

17. A toilet accessory as claimed in claim 13, wherein:

said brush comprises a brush head having bristles projecting from one side and an elongate narrow pick extending from the other side, said pick adapted to extend into and clean water inlet jets beneath a rim in a toilet bowl; and a handle extending at an angle from the head to facilitate use of both the bristles and the pick.

18. A toilet accessory as claimed in claim 17, wherein:

the handle extends at an angle of form about 20° to about 45° relative to the head; and a reflective surface is on the side of said head from which the pick projects, to enable a user to see the jets into which the pick is to be inserted during use.

19. A toilet accessory kit, comprising:

a holder having opposite ends defining receptacles;

a divider extending across the holder and separating the receptacles from one another;

a handle attached to the divider for carrying the holder;

a toilet brush received and supported in one of said receptacles;

a toilet plunger received and supported in the other of said receptacles; and said receptacle for said brush is a cup-shaped member in said one end of said holder.

20. A toilet accessory kit, comprising:

a holder having opposite ends defining receptacles;

a divider extending across the holder and separating the receptacles from one another, said divider and said handle being formed as one piece, separate from the base member, and then secured to the base member to form the holder;

a handle attached to the divider for carrying the holder;

a toilet brush received and supported in one of said receptacles;

a toilet plunger received and supported in the other of said receptacles; and the receptacle for the brush comprising a cup-shaped member in said one end of said holder.

* * * * *